US008919257B1

(12) United States Patent
Hooke et al.

(10) Patent No.: US 8,919,257 B1
(45) Date of Patent: Dec. 30, 2014

(54) 155 MM XM1126 TESTING/TRAINING PROJECTILE

(71) Applicant: The United States of America as Represented by the Secretary of the Army, Washington, DC (US)

(72) Inventors: Ryan Hooke, Sparta, NJ (US); Tyler Myers, late of, Hopatcong, NJ (US); Christopher Stout, Hoboken, NJ (US); Michael Caulfield, Hopatcong, NJ (US); Alan Totten, Dumont, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/772,591

(22) Filed: Feb. 21, 2013

Related U.S. Application Data

(60) Provisional application No. 61/601,636, filed on Feb. 22, 2012.

(51) Int. Cl.
*F42B 8/12* (2006.01)

(52) U.S. Cl.
CPC ..... *F42B 8/12* (2013.01)
USPC ..... 102/529; 102/498

(58) Field of Classification Search
CPC ..... F42B 8/02; F42B 8/12; F42B 8/14; F42B 8/16
USPC ..... 102/439, 473, 498, 501, 517, 529
See application file for complete search history.

(56) References Cited

U.S. PATENT DOCUMENTS

| | | | | |
|---|---|---|---|---|
| 4,446,794 | A * | 5/1984 | Simmons | 102/513 |
| 4,708,065 | A * | 11/1987 | Schilling et al. | 102/529 |
| 6,349,652 | B1 * | 2/2002 | Hepner et al. | 102/519 |
| 7,506,587 | B1 * | 3/2009 | Anderson | 102/489 |

* cited by examiner

*Primary Examiner* — James Bergin
(74) *Attorney, Agent, or Firm* — Michael C. Sachs; Henry S. Goldfine

(57) ABSTRACT

A round for simulating an 155 mm Excalibur ammunition for testing purposes. The round can effectively simulate the flight patterns of a real Excalibur round for testing purposes though made of far less expensive reusable parts. The round is generally fired into a water trough in a long soft catch recovery device so the tested round can later be studied, or generally fired ballistically, to test obturator devices.

12 Claims, 4 Drawing Sheets

155 MM XM1126 TESTING/TRAINING PROJECTILE

CROSS-REFERENCE TO RELATED APPLICATIONS

The present application claims the benefit of priority of U.S. provisional patent application Ser. No. 61/601,636 filed on Feb. 22, 2012, which is incorporated by reference herein.

U.S. GOVERNMENT INTEREST

The inventions described herein may be made, used, or licensed by or for the U.S. Government for U.S. Government purposes.

BACKGROUND OF INVENTION

There is a need for a less expensive way to extensively test the 155 mm M982 Excalibur ammunition for upgrade, redesign or qualification purposes. Actual Excalibur ammunition is quite expensive so it is necessary and desirable to develop an inexpensive testing round that can effectively simulate the flight patterns of the real Excalibur round for testing purposes. There is desire for a simulation round made of far less expensive parts, also desirable that such parts might be reusable and even interchangeable. It is also desirable that each round be recoverable after firing so that flight performance can be studied. It is further desirable if such simulation type round could also accommodate interchangeable parts taken from rounds other than the 155 mm Excalibur type ammunition, for investigation purposes.

BRIEF SUMMARY OF INVENTION

The invention provides a relatively lower cost round that can adequately simulate certain flight patterns/performance and interior ballistic patterns/performance of a tactical M982 Excalibur projectile, suitable for purposes of testing and research of proposed changes to the M982 Excalibur projectile, to its overall configuration, or to individual parts thereof. The invention provides a relatively lower cost (approximately $1,200 USD) round for testing to redesign a full M982 Excalibur projectile, as opposed to firing many actual Excalibur rounds (at approximately $70,000 USD each). The invention could conceivably also be used as a relatively lower cost soldiers' training round for the M982 Excalibur projectile, compared to other possible training rounds for such applications. The invention includes a main body, base and front ogive pieces which can be disconnected, altered, substituted, then reconnected at will to test simulate an M982 Excalibur projectile or to test simulate another round than an M982 under design. The ogive nose cone is also referred to as a "GNC" by its "guidance and navigation control assembly" included therein.

The assembled round is generally tested by firing it out of a cannon tube directly into a recovery device in order to capture it more or less intact for study purposes. Such a device can be a Rail Gun type capture device, e.g., or a Soft Catch Recovery System. The rail gun simply shoots into a closed rail system which has a water medium to slow the projectile down. The Soft Catch Recovery System takes the concept further by using a mass spring damper of air and water in series to better control deceleration of the round and have more accurate data with less balloting. The invention can be fired both in a non-spinning configuration or if desired slightly modify the obturator and fired as spinning projectiles in these systems. Since both the Rail Gun and Soft Catch guns are closed systems, the round does not have to be statically or dynamically stable as the system maintains its vector trajectory allowing it to be versatile. In order to test the electronics at these extreme limits and still determine if failure occurs at gun launch or impact, e.g., these systems and their methods of catching the round were developed to stop the round's forward movement without damaging it.

As mentioned above, this invention can also be used to simulate rounds other than the M982 Excalibur. It could allow one to "mix and match" tactical sub-assemblies from different programs to design a new tactical projectile thereby. It has the capability to make a low cost mass simulant capable of replicating interior ballistics of the munition it is replicating, in this case the M982 Excalibur to do compatibility studies, charge establishment and tube wear studies. It has the capability to take tactical sub-assemblies of a munition and assemble them onto the mass sim to make a semi-tactical munition to test specific tactical sub-assemblies for a given program. And it has the capability to mix and match reliable tactical sub-assemblies from different programs to produce tactical projectiles.

This invention centers around common parts which remain the same for the mass simulant to replicate interior ballistics and for semi-tactical applications simply by changing one to two features on the parts. This allows for economies of scale which further reduce testing costs.

Such concerns are addressed in an economical and logical way, while reducing scrap and helping maintaining production capacities for munitions manufacturers by utilizing a new manufacturing process for producing projectile parts (pierced tube). Since three common parts are used to solve each issue mentioned and are made with the same pierced tube size, a large reduction in cost is achieved compared to conventional mass simulant manufacturing, while achieving an incredibly adaptable system which can be used for anything from compatibility testing, tactical sub-assembly testing to marrying two independent contractors' sub-assemblies together to produce a fully tactical projectile.

A mass simulant section must be able to approximate the volume one would wish to replicate, such as chamber volume/intrusion, along with bourrelet positions, center of gravity, moments of inertia and joint locations.

The mass stimulant base section (which is inert) must be able to: match the chamber volume of the M982 tactical base along with center of gravity. However, a real live tactical M982 base could be used at the position of the inert base to perform XM982 base lot acceptance testing or an alternate tactical base if desired.

The ogive used in this invention is a mass simulant of the real tactical guidance and navigation control assembly. A tactical GNC however could be used at the position of the ogive for live fire testing of a real GNC unit if desired.

The invention can accomplish Permissible Maximum Pressure testing of 155 mm cannons PMP+25%, something not usually attempted; can be used to test new government obturator designs, and can survive blow-by if an obturator fails catastrophically; the invention has tactical joints which allow it to replicate the actual loads seen in Excalibur 1A while testing components and assemblies usually not attempted this way.

Many of today's precision munitions are fin stabilized; including the Excalibur round. In order to be shot using a rifled cannon, a fin stabilized projectile must seal the gas evolved from the propellant behind it in order to produce the pressure needed to propel the projectile out of the cannon tube. This is accomplished by using an obturator device. The obturator seals gases behind it much like a piston ring inside of a car engine. The obturator is often placed near the rear of the projectile. The obturator also causes an interference fit between the rifling in the tube and the projectile, but unlike with a copper band, the obturator is not coupled to the body in the radial direction through any mechanical means. Hence, when the projectile travels down the tube the rifling spins the obturator up and the interference between the obturator and the tube wall seals gases but the projectile is decoupled from the obturator and the round does not spin at the same rate the obturator does. This reduction in spin from the obturator to the projectile is needed for some of today's guidance and navigation packages in precision guided munitions.

The guidance and navigation packages inside precision munitions are very expensive. This fact and the desire to increase the range of these precision munitions have necessitated the need for projectiles to be subjected to extreme loads. Statistically, fewer tests can be carried out near the upper bounds of a projectile's operating conditions (i.e. Permissible Maximum Pressure (PMP)+25% above normal) at a lower cost than testing at a little above normal operating conditions (i.e. PMP+5% above normal) to provide the similar statistical inference.

In order to test the electronics at these extreme limits and still determine if failure occurs at gun launch or impact, a way of catching the round was developed to stop the round's forward movement without damaging it allowing one to retrieve and diagnose the round after firing.

This invention not only is a M982 mass stimulant but allows one to mix and match tactical sub-assemblies from different programs to produce a tactical projectile.

OBJECTS OF THE INVENTION

Accordingly, it is an object of the present invention to provide means for testing Excalibur ammunition and components by means that are far less expensive than firing expensive multiple real M982 Excalibur rounds.

Another object of the present invention is to provide an inexpensive alternate round that can effectively simulate the flight patterns of a real Excalibur round or other tactical rounds for testing purposes.

It is a further object of the present invention to provide a testing round wherein can be mixed and matched tactical versus simulated Excalibur round subsections, or tactical versus simulated round subsections from rounds other than Excalibur as well as from Excalibur, to build up such testing rounds as desired for required testing runs.

It is a yet further object of the present invention to provide a simulated Excalibur or other type round which can be recovered in a soft catch recovery system or a rail gun recovery device after firing, to study such tested round's in-flight properties.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION

Figure 1:
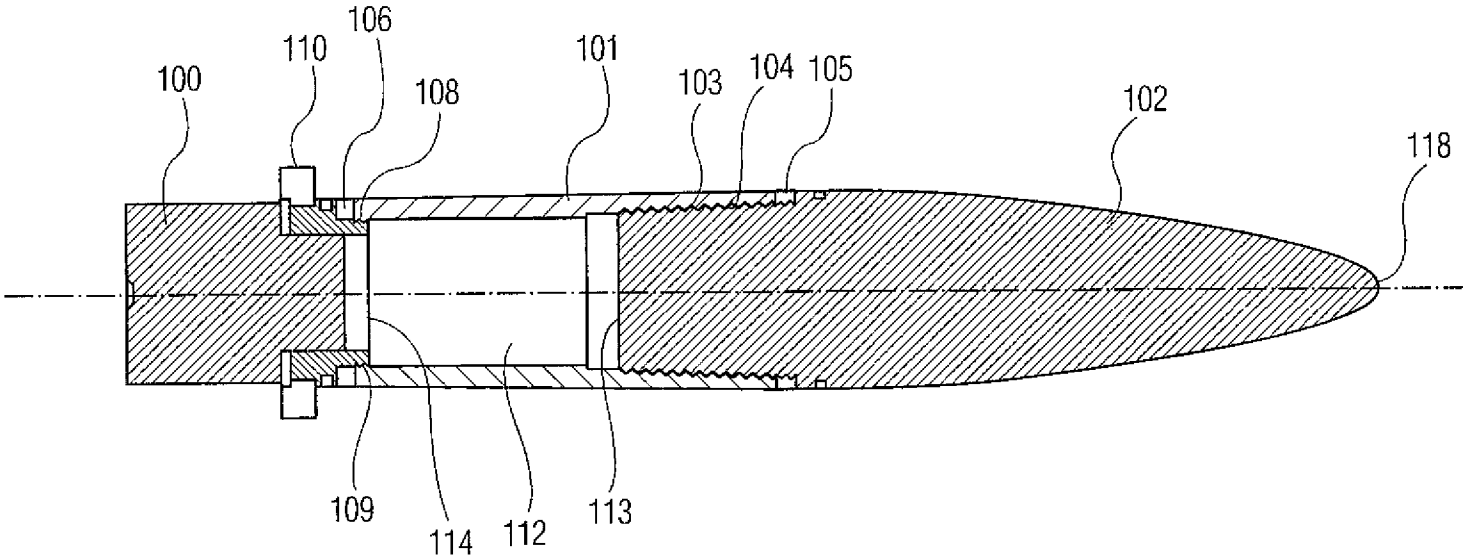
FIG. 1 shows an assembled test round according to this invention.

FIG. 1 shows a cross section of a cylindrically made round according to this invention. The round has an ogive shape front piece 102. Front piece 102 has a rear face 113 plane perpendicular to the round's longitudinal axis 118, and a rear plug cylindrically shape part thereon. The front piece 102 has a defined length from the front tip of the ogive to the rear face 113. Front piece 102 is typically made of solid aluminum material. Similarly, there is a base piece 100 which can be made of solid aluminum. It is made to have the same volume as the real Excalibur base also to weigh approximately the same and so that the center of gravity will be the same. Base piece 100 has a cylindrically shaped front area with a defined front plane 114 that is plane perpendicular to the round's longitudinal axis.

Figure 2:
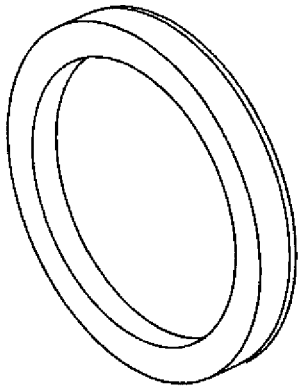
FIG. 2 shows a weight device which might be used for component 105 or 106 according to this invention.
Figure 3:
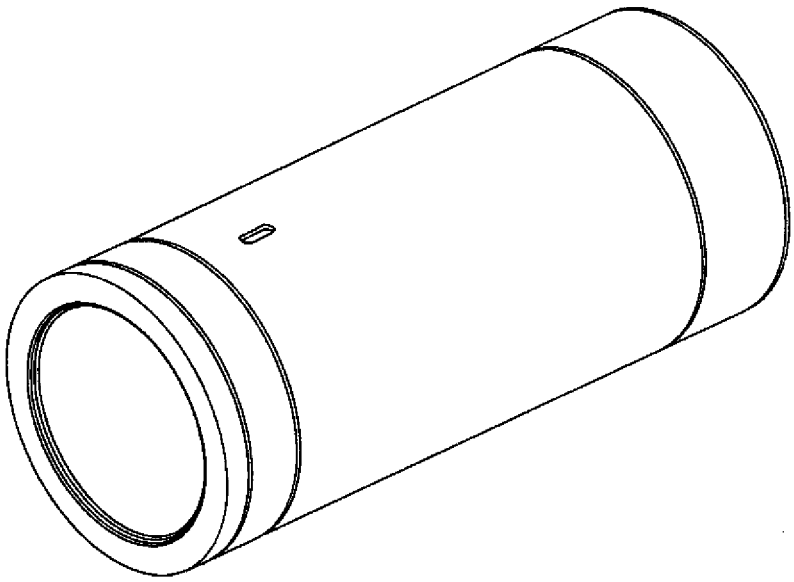
FIG. 3 shows a view of a main body piece, according to this invention.
Figure 5:
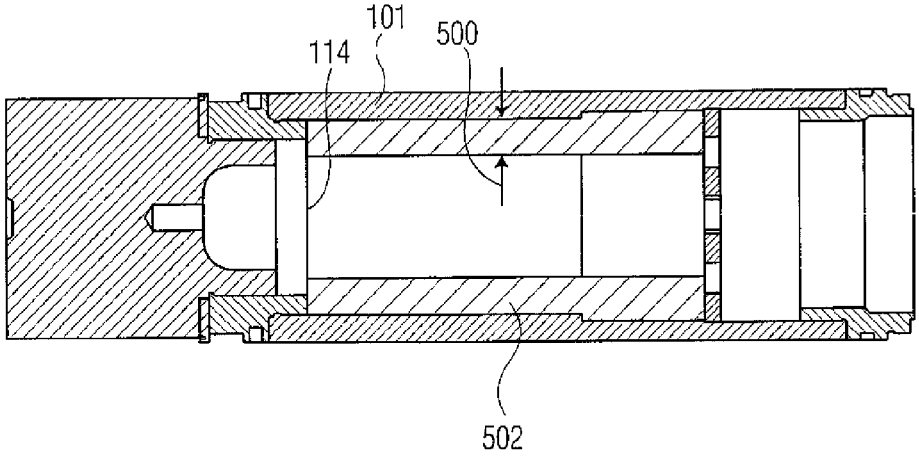
FIG. 5 shows positioning of a ballast 502 in the cargo portion of a round according to this invention.

There is also in FIG. 1 a hollow cylindrically shaped main body part 101 which is sized with matching bourrelets—and also has internal threading 103 at one end of the main body part so it can perfectly have screwed there into and receive thereat a real GNC from a real Excalibur round, and wherein the other end of the main body part is also sized and has internal threading 109 thereat so it can perfectly have screwed in and receive thereat a real tactical base from a real Excalibur round. The circumference of the said front area of base 100 is sized and also has external threading 108 thereon so base 100 can also mate with the established internal threading 109 inside main body part 101. Similarly, the circumference of the rear plug on front piece 102 has external threading 104 thereon so front piece 102 can also mate with the established internal threading 103 inside main body part 101. To be used as a practice round then, the front piece 102 is screwed to seat inside main body part 101 (however weights such as 105, 119, 120 or 502 (FIGS. 1 and 2) may be placed in between 102 and 101 as 102 seats thereat). Similarly, base 100 is screwed to seat inside main body part 101 (however weights such as 106 (FIG. 2) may be placed in between 100 and 101 as 100 seats thereat). External to base 100 can be placed an obturator 110, which is a plastic or metallic ring of material slipped in place (but not permanently joined), and optionally could have lubricant there, between obturator and base piece 100. It is a slipping driving band for this 155 mm de-spun artillery real Excalibur round. Main body part 101 is typically made of steel. It may be fabricated from cylindrical solid steel stock that is bored through, however it is possible to obtain steel tubing (pierced tubing body blank) for about only $250, then add the internal threadings 109 and 103 through machining. The space between planes 113 and 114 defines a cargo space 112. The assembly shown in FIG. 1 is about 100 pounds and is an effective simulation of an actual Excalibur round, and the parts 100, 101 and 102 must also be formed so that the assembled FIG. 1 round has an identical exterior overall outline profile (within tolerances). The weight of front piece 102 approximates the weight of the front electronics components of an Excalibur. Similarly the weight of the rear base part 100 approximates the weight of the rear base of an actual Excalibur round. As was mentioned, the internal threading 109 and dimensions inside of 110 were made to match the real base part from an actual Excalibur round. Similarly, the internal threading 103 and dimensions inside of 110 were made to match the real front electronics components of a real Excalibur round. Thus, if desired, a real base part from an actual Excalibur round can be screwed in, in place of part 100. Similarly, if desired, front piece 102 may be unscrewed and a real front GNC electronics components of a real Excalibur round could be installed instead. It can be appreciated that main body portion 110 could also be replaced by a real main body portion from a real Excalibur round. So, there is great versatility here in mixing and matching parts from a real Excalibur round with simulation parts on this simulation round, for redesigning parts from a real Excalibur round and then effectively testing same weights 105, 119, 120, 502 may be needed to be added (as was mentioned) in order to fine balance out the round as need be when the round is simulated in this manner, because this simulated round is not absolutely perfect (but very close to) the real Excalibur round in size, shape, weight, volume, center of gravity, and moments of inertia. The weights can come in the shape of flat washers as shown in FIG. 2, in select thicknesses/weights. The washers need no threading to be held in place. They can be made of various materials and in various shapes as long as they can seat in the spaces provided, as shown here in FIG. 1. Another method is to put a hollow cylindrical, tapered or stepped sleeve 502 (FIG. 5) that fits snugly just inside 101, as added weight and is snugly mounted in the cargo area so it can't move about in any direction. In this way one could add ballast weight inside the cargo area. The sleeve could be made of steel, aluminum or other materials, and could be available in various wall thicknesses 500 to give choice as to weight and size, density and center of gravity. If desired, the length of front piece 102 could theoretically be shortened to lessen the weight of front piece 102, by shaving plane 113 further back. An advantage of cargo space 112 as shown in FIG. 1 is that cargo added therein for testing purposes can be secured in place merely by tightening down front piece 102 or base 100 (or both 102 and 100) to hold the cargo snugly in place between planes 113 and 114. It is no small feat in terms of insight and much trial and error to get the proper sized and weighted parts 100, 101 and 102 to achieve the sometimes competing requirements of physical size, weight distributions, centers of gravity, moments of inertia, nature of simulated cargos, attachment of obturators etc, structural dynamic responses which survives gun launch and matches Excalibur's to match the real Excalibur round and performance. The Table below shows some of these properties being balanced. An achieved actual simulation of a selected tactical Excalibur round shows how very well the simulation round works according to this invention for weight, center of gravity, for moments, etc., all the while that the simulation round is still faithful to the actual lengths and profile of this real selected tactical Excalibur round.

TABLE (Mass Property Comparison)

| Property | Sample Round | Simulated Round |
|---|---|---|
| Total Mass (lbs.) | 1 | <1% |
| Overall C.G. from tip (in.) | 1 | <1.1% |
| Base Mass (lbs.) | 1 | <1% |
| Base C.G. from back (in.) | not recorded here | * |
| Total Length | 1 | <1% |
| $I_{xx}$ (lb-in$^2$) @ C.G. | 1 | <1.5% |
| $I_{yy}$ (lb-in$^2$) @ C.G. | 1 | <1.5% |
| $I_{zz}$ (lb-in$^2$) @ C.G. | 1 | <1% |

(* well within its accepted range)

Figure 6:
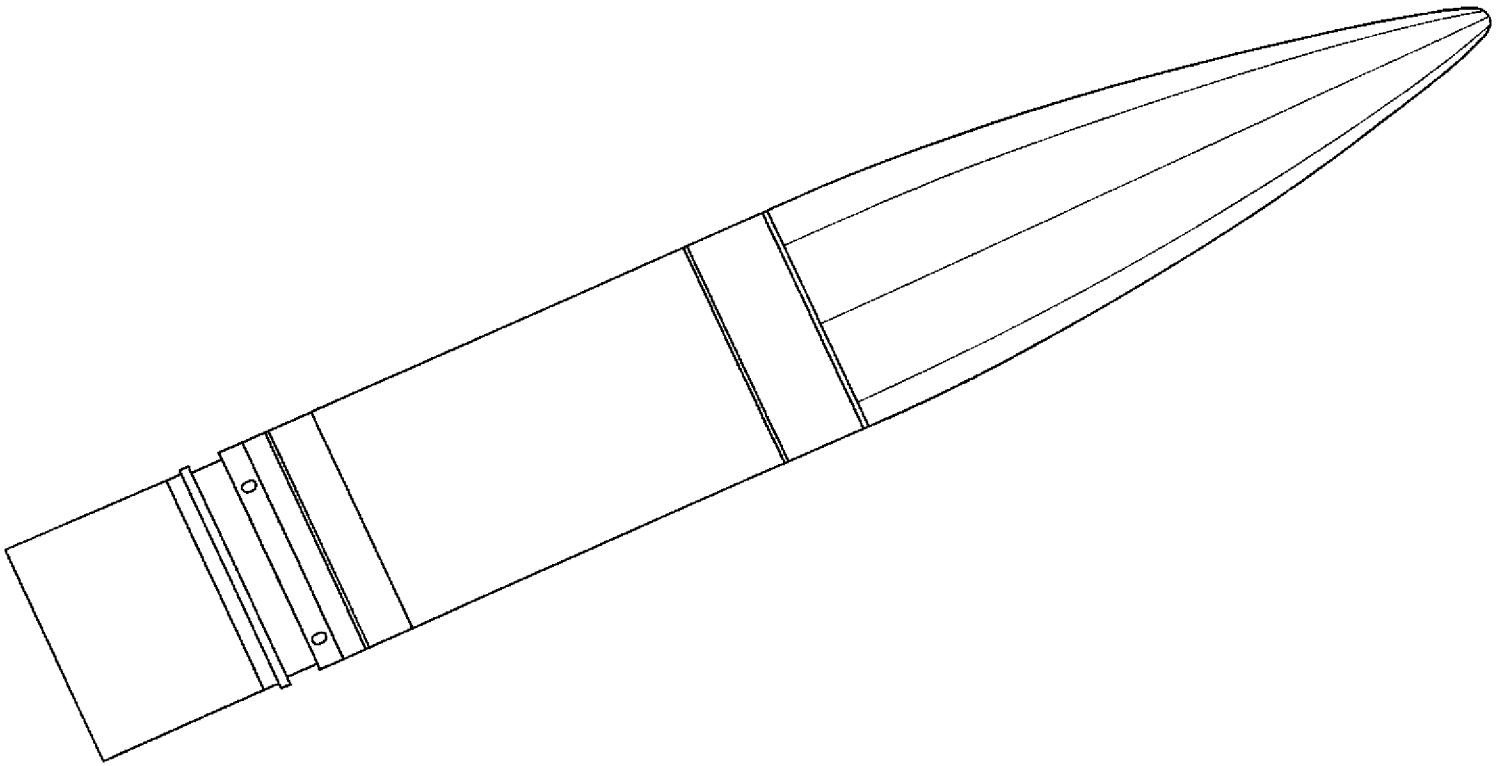
FIG. 6 shows the exterior view of an assembled test round according to this invention.

FIG. 6 shows the profile of a fully assembled round according to this invention. The parts can usually be reused from test to test if not unduly damaged.

An example of cargo from the real Excalibur round that might be simulated for addition as shown here in FIG. 1 might be a warhead or a simulated warhead or in another example a payload of specialized equipment to measure pressure/smoke escaping around tested obturator designs, from base up to main body portions. This pressure/smoke must be made near zero if a superior obturator design is to be achieved. The recovered round can also be examined for abrasions on its exterior that might indicate flight path irregularities that suggest need for a redesign. It can be seen that the round of this invention can also be used for firing real tactical base pieces for extensive testing. Another use is for performing interior ballistics compatibility testing. This round could also be used for training purposes. The round could be used for spiral wear testing when an F-fuze is included on the simulation round. It may also be used to test/perfect canard covers, O-rings, radomes, breech pressures, materials deformations of the round, and harmonic ringing among other concerns for the real Excalibur round. This round could be used to carry components for precision munitions. The round could be used to test fire a real GNC on front and fire into a SCat gun with on-board instrumentation if desired. The round could also be utilized as a cargo round to transport items in its hollow body.

Figure 4:
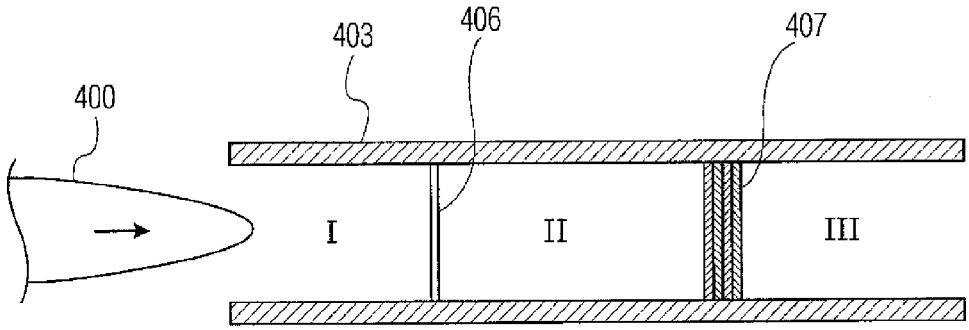
FIG. 4 shows a cross section view of a Soft Catch recovery system according to this invention.

FIG. 4 conceptually shows a SCat device into which the round 400 is usually fired (at 300-1000 meters per second) into a hollow steel cylinder 403 for testing purposes, to capture the round at the end at zero velocity. Cylinder 403 could be an old cannon tube no longer otherwise used. The captured rounds can be studied for flight performance, wear, etc. The Excalibur round is fin stabilized so it is not intended to spin in flight (at least not by very much more than 0-50 HZ) and could be fired out of a smooth bore cannon tube (though rifled cannon tube is also possible). This round therefore also isn't meant to spin. The first region (I) of the SCat device is just air which creates a shock effect that acts to slow down the round. Region (between diaphragm 406 and piston 407) has pressurized air which also creates a shock effect that further acts to slow down the round, after it bursts through the diaphragm 406. Region III, beyond the piston 407 is water. These also further act to slow down the round, particularly after it bursts through the piston 407, then eventually the round comes to rest in the water downstream. The piston 407 is actually a composite of rubber, wood, plastic, metal layers so the piston won't spall into little bits as the round breaks through it. The SCat device is about 600 feet long, but most of its length is in the air track in Region II.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A round for simulating an 155 mm Excalibur ammunition for testing purposes, said round fired into a SCat soft catch recovery device, said round having a defined longitudinal axis and further comprising:

a metallic hollow cylindrically shaped main body part sized and having internal threading at a first end thereof so the main body part can receive a real GNC unit from a real Excalibur round, and wherein the main body part is also sized and has internal threading at a second end thereof so it can receive a real tactical base from a real Excalibur round, and;

an aluminum front piece having an ogive shaped nose having a tip thereon, and a rear face plane perpendicular to the round's longitudinal axis, the front piece having a defined length from the nose tip to the rear face, said front piece also having a cylindrically shaped rear plug having outside threads on the circumference thereon which plug can also compatibly mate it into the main body part first end, and;

an aluminum base piece having a cylindrically shaped front area with a defined front plane that is plane perpendicular to the round's longitudinal axis, the circumference of said front area also having external threading thereon which can compatibly mate into the main body part second end, and;

wherein an open cargo space is created in between the front piece's rear face plane and the base piece's front plane when the front piece and base piece are screwed in at their respective first and second ends of said main body part, and wherein desired cargo can be firmly held in place in said cargo space by screw tightening said front piece and said base piece, and;

first washer shaped weights sized to fit in the first end of the main body in between the front piece and the main body and second washer shaped weights sized to fit in the second end of the main body in between the base piece and the main body, and a hollow cylindrical sleeve sized to fit snugly just inside the cargo area to add ballast weight inside the round and inside the round's cargo area respectively, and;

a plastic slipping driving band obturator ring applied around the base piece, and optionally having lubricant there between obturator and base piece, and;

wherein the cargo comprises instrument components to measure obturator pressure blow by from base piece forward to main body piece, and;

wherein the SCat device comprises a hollow steel cylinder into which the round is fired for testing purposes, a first distance to break through a diaphragm, then a second distance in pressurized area to break through a piston, then into a water medium of some 550 feet to come to a stop.

2. The round of claim 1 wherein the obturator comprises material that is selected from the group of: metallic, plastic, metal plastic composite, or metal plated material.

3. The round of claim 1 wherein the ogive of the front piece has the same exterior profile as on a real Excalibur round.

4. The round of claim 1 wherein the base piece exterior has the same volume as on a real Excalibur round.

5. The round of claim 1 wherein the main body piece exterior has the same profile as on a real Excalibur round.

6. The round of claim 1 wherein the round when assembled has the same exterior profile as a real Excalibur round.

7. The round of claim 1 wherein the front piece has the same weight and center of gravity as the real GNC unit from a real Excalibur round.

8. The round of claim 1 wherein the main body piece has the same weight and center of gravity, moments of inertia, as the real main body piece from a real Excalibur round.

9. The round of claim 1 wherein the base piece has the same weight and center of gravity as the real base unit from a real Excalibur round.

10. A round for simulating an 155 mm Excalibur ammunition for testing purposes, said round having a defined longitudinal axis and further comprising:

a steel hollow cylindrically shaped main body part sized and having internal threading at a first end thereof so the main body part can receive a real GNC unit from a real Excalibur round, and wherein the main body part is also sized and has internal threading at a second end thereof so it can receive a real tactical base from a real Excalibur round, and;

an aluminum front piece having an ogive shaped nose having a tip thereon, and a rear face plane perpendicular to the round's longitudinal axis, the front piece having a defined length from the nose tip to the rear face, said front piece also having a cylindrically shaped rear plug having outside threads on the circumference thereon which plug can also compatibly mate it into the main body part first end, and;

an aluminum base piece having a cylindrically shaped front area with a defined front plane that is plane perpendicular to the round's longitudinal axis, the circumference of said front area also having external threading thereon which can compatibly mate into the main body part second end, and;

wherein an open cargo space is created in between the front piece's rear face plane and the base piece's front plane when the front piece and base piece are screwed in at their respective first and second ends of said main body part, and wherein desired cargo can be firmly held in place in said cargo space by screw tightening said front piece and said base piece, and;

first washer shaped weights sized to fit in the first end of the main body in between the front piece and the main body and second washer shaped weights sized to fit in the second end of the main body in between the base piece and the main body, and a hollow cylindrical sleeve sized to fit snugly just inside the cargo area to add ballast weight inside the round and inside the round's cargo area respectively, and;

a plastic slipping driving band obturator ring applied around the base piece, and optionally having lubricant there between obturator and base piece, and;

wherein the cargo comprises instrument components to measure obturator pressure blow by from base piece forward to main body piece.

11. The round of claim 10 wherein the obturator is metallic or composite metal plastic.

12. The round of claim 10 wherein said round is fired into a SCat soft catch recovery device, wherein the SCat device comprises a hollow steel cylinder into which the round is fired for testing purposes, a first distance to break through a diaphragm, then a second distance in pressurized area to break through a piston, then into a water medium of some 550 feet to come to a stop.

* * * * *